United States Patent [19]

Calhoun

[11] 4,255,070

[45] Mar. 10, 1981

[54] SINGLE-BOLT ROOF SUSPENSION FOR OVERHEAD TRACK

[75] Inventor: Walter L. Calhoun, Chagrin Falls, Ohio

[73] Assignee: McNeil Corporation, Akron, Ohio

[21] Appl. No.: 105,727

[22] Filed: Dec. 20, 1979

[51] Int. Cl.[3] ..... E01B 25/24; E21D 20/02

[52] U.S. Cl. ..... 405/260; 52/39; 52/704; 104/111; 248/317; 248/647

[58] Field of Search ..... 405/259-262; 248/647, 317, 327; 104/111, 115-117, 105-107; 52/39, 704

[56] References Cited

U.S. PATENT DOCUMENTS

| | | | |
|---|---|---|---|
| 538,610 | 4/1895 | Hunt | 104/111 |
| 3,219,199 | 11/1965 | Lagerstrom | 104/111 X |
| 3,990,665 | 11/1976 | Joussemet | 248/317 X |
| 4,051,683 | 6/1976 | Koval | 405/261 |
| 4,116,134 | 9/1978 | Troth | 104/111 |

*Primary Examiner*—Ernest R. Purser

*Attorney, Agent, or Firm*—Watts, Hoffmann, Fisher & Heinke Co.

[57] ABSTRACT

An improved roof or ceiling fitting for a monorail system, particularly useful in low seam coal mines. Rail suspension assemblies are each secured in a single counterbored roof hole and are adjustable vertically and laterally for alignment. A bolt is anchored in a hole and supports a collar-end of a crank-shaped suspension unit within the counterbore. A suspension-pin end offset from the collar axis extends below the roof to support a cleat for attachment to a rail. A roof plate is threaded on the collar and bears against the roof.

6 Claims, 4 Drawing Figures

SINGLE-BOLT ROOF SUSPENSION FOR OVERHEAD TRACK

BACKGROUND OF THE INVENTION

1. Field of the Invention

The invention relates to overhead rail-type material handling systems and more particularly to a single-bolt roof suspension for systems useful in mines.

2. Prior Art

One approach to suspending an overhead rail-type material handling system or apparatus is shown in U.S. Pat. No. 4,116,134 to Paul H. Troth entitled, "Hangers for Overhead Suspended Track." That system provides a support that permits some misalignment and is useful where overhead clearance is extremely limited. However, the mounting arrangement requires two roof bolts and the associated problem of locating and drilling the two holes for each suspension point to properly locate the support along a mine roof. Thus, notwithstanding the flexibility and the low head room achieved in that suspension, the two roof bolt requirement could be viewed as disadvantageous from a coal miner's point of view. In practice, the need to drill the sets of two holes, typically on six inch centers, in a mine roof on an axis perpendicular to a center line established for the monorail support, can prove difficult. Moreover, the pairs of holes have to be individually drilled because dual head roof drilling machines cannot drill on such close centers.

Single roof bolts, expandable into drilled holes, are disclosed by U.S. Pat. No. 3,219,199 issued to G. Lagerstrom, to support overhead rails in a mine tunnel.

Other overhead supports are shown by patents referenced in the aforementioned U.S. Pat. Nos. 4,116,134 and 3,219,199.

SUMMARY OF THE INVENTION

The present invention provides new and improved roof or ceiling fittings for a monorail system, particularly useful in low-seam coal mines. The fittings and monorail system are especially suitable for installations where overhead clearance is extremely limited and in which the rail is supported very close to the roof of the tunnel or mine shaft. The invention provides a novel and improved suspension device for an inverted T-shaped rail of an overhead suspended rail-type material handling apparatus, which permits a degree of misalignment and is easy to install, is reliable in operation, and supports the rail with some flexibility close to the ceiling or roof beneath which the apparatus is installed.

The invention utilizes a single bolt suspension assembly that eliminates the need to locate and drill two roof bolt holes for each suspension point. By using a single hole, tolerance problems with hole center lines and the cost of drilling the second hole, including layout, location and drilling, as well as the cost of the additional roof bolt and resin grout material, are all eliminated. In addition, the main suspension unit is typically lighter and smaller than a two-holed unit, offering a substantial advantage to the miner who must transport the suspension assemblies and related materials to the point of installation.

Each single-bolt suspension assembly is supported in a counter-bored hole in the mine roof and each is adjustable vertically and laterally relative to the hole position, for alignment. A roof bolt is suitably anchored, as by grout or an expandable end or fitting, in a hole in the mine roof and supports a collar-end of a crank-shaped suspension unit within the counter-bore. A suspension-pin end of the suspension unit is offset from the collar axis and extends below the mine roof to support a cleat for attachment to a rail. Lateral and vertical adjustment of the pin end and the supported cleat is achieved by rotation of the suspension unit relative to the bolt. Once the suspension unit is adjusted to the desired height and lateral location, the collar is anchored in the counter-bore with grout. A roof plate is threaded on the collar and bears against the roof to lend rigidity to the suspension assembly and to prevent local roof deterioration.

DETAILED DESCRIPTION OF A PREFERRED EMBODIMENT

Figure 1:
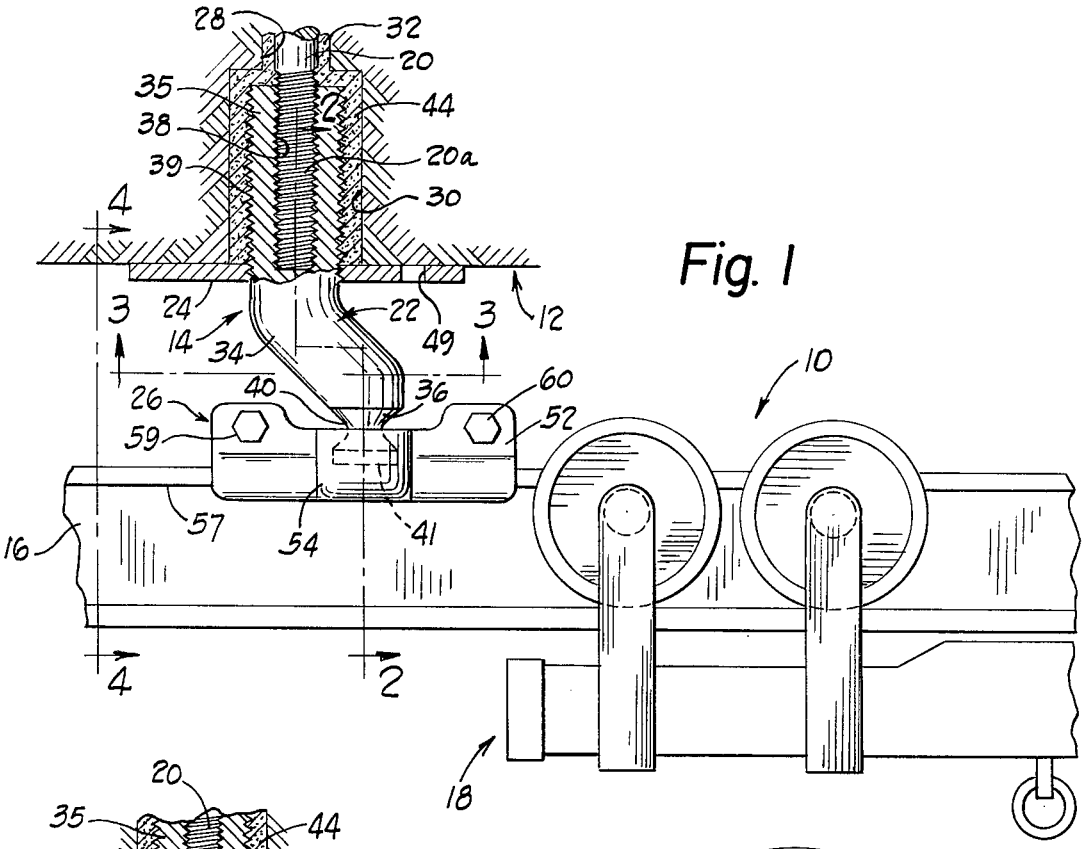
FIG. 1 is a fragmentary view, partly in section, of an overhead suspended monorail material handling system embodying the present invention.

Referring to the drawings, an overhead monorail material handling apparatus, indicated generally by reference numeral 10, is shown suspended from a mine roof 12 by a suspension assembly 14, representative of a number of such assemblies at spaced intervals along the monorail apparatus. The monorail apparatus 10, as shown, includes an overhead rail 16 of inverted T shape, along which a trolley 18 is moveable. The trolley 18, illustrated, is of the hand-propelled material carrier type. The term "trolley" as used herein, refers to any equipment supported by and moveable along the rail 16, such as hand and/or power-propelled carriers, tractors, crane trucks, and the like. The rail 16 is suspended closely adjacent to the roof 12, by the suspension assemblies 14 suitably located along the rail.

The suspension assemblies 14 each include a bolt 20, a suspension unit 22, a roof plate 24, and a cleat or fitting 26 secured at the lower end of the unit 22 and attached to the rail 16.

The bolt 20 has threads **20*a* at one end. As shown in FIG. 1, the bolt is oriented vertically, with the unthreaded end upward, received within a drilled hole 28 in the roof 12. The drilled hole 28 has an enlarged counter-bore 30 opening through the mine roof. The length of the bolt is substantially equal to the depth of the hole and counter-bore, and the threads 20*a* extend substantially the length of the counter-bore. The bolt is typically secured in the hole 28 perpendicular to the roof, either by grout 32**, preferably a quick setting resin grout, about the unthreaded portion of the bolt, or by an expandable fitting (not shown) or the bolt itself can be expandable.

The suspension unit 22 is comprised of an elongated crank-shaped body 34 having a collar portion 35 at one end (the upper end as oriented in use) and a suspension pin portion 36 at the other end, parallel and offset from the central axis of the collar portion. The collar end of the body 34 has a central, threaded, bore 38 of sufficient depth to receive substantially the entire threaded portion of the bolt 20. The collar portion 35 has external threads 39 to support the roof plate 24. The suspension pin end has a neck 40 and a head 41 to support the cleat 26 in a manner that permits some pivoting of the cleat relative to the body 34.

Figure 2:
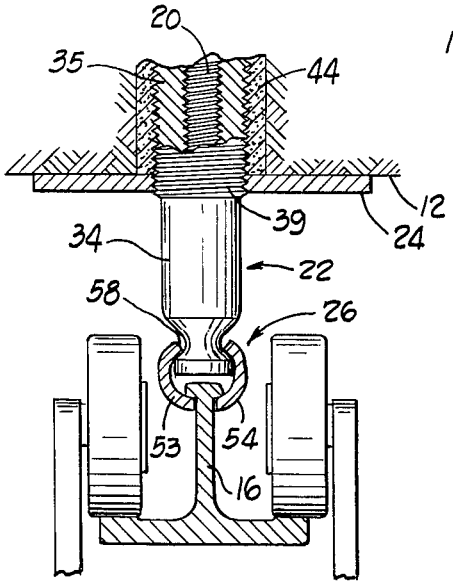
FIG. 2 is a framentary sectional view approximately on the line 2—2 of FIG. 1.

By virtue of the offset of the pin end 36 with respect to the central axis of the collar portion 35, rotational adjustment of the body 34 relative to the bolt 20 adjusts the lateral location of the head 41 relative to the bolt. As a result, alignment of the hole 28 and bolt 20 with the intended path of the rail is not critical, within the limits of the offset between the head and collar portions. In addition, by virtue of the substantial threaded portions of the bolt and collar portion, the depth of the hole 28 and vertical location of the bolt 20 is not critical relative to the desired height of the track 16, within the limits of the thread engagement between the collar portion and bolt. Moreover, only a slight vertical change in the height of the head 41 accompanies a rotational adjustment of the body 34 through 360°, the actual distance depending upon the pitch of the threads 20*a*. Once the suspension unit 22 is secured to the bolt and adjusted, the volume of the counter-bore 30 surrounding the collar portion 35 is filled with a grout 44, preferably a slow setting resin grout. As illustrated in FIGS. 1 and 2, the threaded collar portion 35 extends below the mine roof 12.

Figure 3:
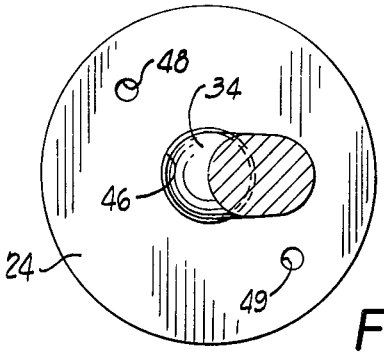
FIG. 3 is a view, partly in plan and partly in section, taken approximately on the line 3—3 of FIG. 1; and, FIG. 4 is a fragmentary sectional view approximately on the line 4—4 of FIG. 1.

The roof plate 24, as shown in FIG. 3, is circular, with a cylindrical, threaded central opening 46. The opening receives the pin end of the suspension unit 22, so the plate fits over the unit and threads onto the collar portion 35, which extends below the mine roof. The plate is tightened against the roof to prevent local roof deterioration and to lend rigidity to the suspension assembly. Two diametrically opposed holes 48, 49 are provided in the plate for receiving a spanner wrench to facilitate tightening of the plate against the mine roof.

Figure 4:
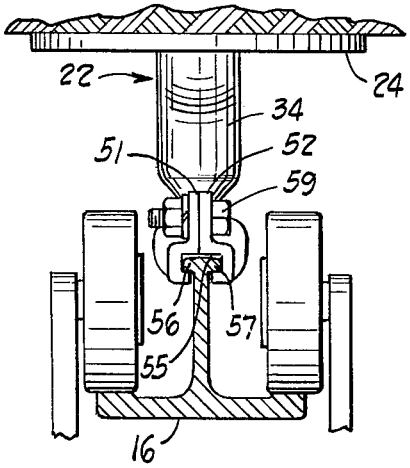

The cleat 26 is comprised of two plate-like clamping members 51, 52 with semi-spherical center parts 53, 54, respectively, and with reverse bends at opposite ends (i.e., on each side of the semi-spherical center part) to provide T slots 55 open at the lower side of the clamp assembly, (see FIG. 4), and within which parts of the top of the rail 16, more particularly upper narrow flanges 56, 57 are received and clamped. The construction is such as to provide a cleat with a T slot having a through aperture 58 intermediate the ends of the slot, a part of which slot is spherical shaped for receiving the head 41 of the suspension unit 22. The two plate-like clamping members 51, 52 are secured by bolts 59, 60 or other suitable clamping means. The construction of the cleat 26 and also equivalent cleats are shown in the aforementioned U.S. Pat. No. 4,116,134, the disclosure of which is incorporated herein by reference.

By way of example and not limitation, a preferred embodiment of the suspension assembly 14 and its installation to a mine roof is as follows:

A $\frac{3}{4}$ inch resin grout roof bolt 20 is used having a 3 inch threaded portion on one end, specifically a threaded bolt designated "16 NF SAE $\frac{3}{4}$." The suspension unit 22 has a collar of 1&$\frac{1}{2}$ inch outside diameter approximately three inches in length and completely threaded, the thread being designated specifically, "12 NF SAE 1&$\frac{1}{2}$." The central axis of the suspension pin end 36 is offset one inch from the center line of the collar portion 35.

A standard roof drilling machine is fitted with a one inch diameter drill. A two inch diameter by three inch long counter-bore is fitted to the base of the drill bit. The one inch diameter hole and a two inch diameter counter-bore are drilled in one operation. The roof bolt is installed and secured with a quick setting standard resin grout in the one inch diameter hole in the normal way.

The suspension unit 22 is then threaded onto the lower end of the mine roof bolt 20 and adjusted by rotation until the required height for the monorail system is achieved. Approximately two inches of vertical adjustment are possible with this unit. More adjustment is possible if the collar area is lengthened. Because it is unlikely that the hole 28 drilled for the roof bolt will be exactly on the proposed monorail center line, horizontal adjustment of up to one inch from the hole center line is achieved by rotating the suspension unit. One complete rotation of the unit affects vertical adjustment 1/16 of an inch. Typically, no more than 180° of rotation will be necessary for final adjustment.

When the suspension unit 22 has been threaded onto the roof bolt and adjusted so the suspension pin end 36 is in the approximate correct horizontal and vertical position, the roof plate 24 is threaded loosely onto the external threads 39 of the collar portion that extends below the mine roof. The cleat 26 and the monorail track 16 are then attached.

A final adjustment of the suspension unit 22 is made and slow setting epoxy resin grout is packed about the suspension unit, completely filling the volume of the counter-bore about the collar portion 35 in the mine roof. The roof plate 24 is then adjusted to fit tightly to the mine roof.

While a preferred embodiment of the invention has been disclosed in detail, it will be apparent that various modifications and alterations can be made therein without departing from the spirit and scope of the invention set forth in the appended claims.

What is claimed is:

1. In an underground monorail system, an improved suspension assembly for use at spaced suspension points of an overhead track, comprising: a single roof bolt adapted to be secured in a hole drilled into a mine roof and having a lower threaded portion adapted to be located in an enlarged counterbore of the hole at the surface of the mine roof; a suspension unit of generally elongated shape, with a collar portion at one end adapted to be received in the counterbore and having an internally threaded bore for receiving the lower threaded portion of the roof bolt to connect the suspension unit to the bolt and having external threads, said external threads being adapted to extend beyond the mine roof when the suspension unit is secured to the bolt, said suspension unit having a suspension pin at the other end offset from the axis of the threaded bore, the position of the pin being therefore adjustable radially of the axis of the bore through rotation of the suspension unit relative to the bolt; and a roof plate with a central opening large enough to receive the suspension pin and threaded to engage with the external threads on the collar portion of the suspension unit.

2. A roof connection for an overhead rail, capable of horizontal and vertical adjustment comprising a bolt adapted to be secured vertically and having a lower threaded end, a suspension unit of a crank arm construction, one end having external threads and an internally threaded bore in which the bolt is received, and the other end offset from said one end and configured to attach a rail fitting, and a plate with a threaded opening secured to the external threads of the suspension unit.

3. In a mine having a roof and an overhead rail secured to and suspended from the roof: a vertical hole and counterbore in the mine roof; a bolt secured in the hole and having a threaded portion within the counterbore; a rail suspension unit with a collar portion at one end and an offset suspension pin portion at the other end, said collar portion being smaller across than the counterbore and having an internally threaded bore that threadedly receives the threaded portion of the bolt, said collar portion also having external threads that extend below the mine roof; and a roof plate substantially larger than the opening of the counterbore in the roof, with a central internally threaded cylindrical opening larger than the suspension pin portion and in threaded engagement with the external collar threads, said plate being secured tightly against the mine roof.

4. In a mine having a roof and an overhead rail secured to and suspended from the roof: a vertical hole and counterbore in the mine roof; a bolt secured in the hole and having a threaded portion within the counterbore; a rail suspension unit with a cylindrical collar portion at one end and an offset suspension pin portion at the other end, said cylindrical collar portion being smaller in diameter than the counterbore and having an internally threaded bore that threadedly receives the threaded portion of the bolt within the counterbore, said cylindrical collar portion also having external threads that extend at least partially within the counterbore and also below the mine roof; grout within the counterbore and surrounding the collar portion; and a roof plate substantially larger than the opening of the counterbore in the roof, with a central internally threaded cylindrical opening larger than the suspension pin portion and in threaded engagement with the external collar threads, said plate being secured tightly against the mine roof.

5. In a method of suspending an overhead support to a mine roof, the steps comprising: drilling a single vertical counterbored hole at the intended location of each of a number of spaced suspension assemblies for the support, securing an end of a bolt in the hole so a threaded portion of the bolt extends within the counterbore, securing a crank-shaped suspension unit having an internally and externally threaded collar at one end and an offset suspension portion at the other end to the bolt by threading the collar onto the bolt within the counterbore, adjusting the portion of the offset suspension portion by rotating the suspension unit relative to the bolt, filling the counterbore about the collar with grout, and securing a roof plate to the external collar threads, tightly against the roof.

6. In a method of suspending an overhead support to a mine roof, the steps comprising: drilling a single vertical counterbored hole at the intended location of each of a number of spaced suspension assemblies for the support, securing with grout an end of a bolt in the hole so a threaded portion of the bolt extends within the counterbore and free from grout, securing a crank-shaped suspension unit having an internally and externally threaded collar at one end and an offset suspension portion at the other end to the bolt by threading the collar onto the bolt within the counterbore, adjusting the portion of the offset suspension portion by rotating the suspension unit relative to the bolt, filling the counterbore about the collar with grout, and securing a roof plate to the external collar threads, tightly against the roof.

* * * * *